United States Patent [19]

Ploppa et al.

[11] Patent Number: 4,790,153

[45] Date of Patent: Dec. 13, 1988

[54] SAFETY DEVICE FOR FLAT-BED KNITTING MACHINES

[75] Inventors: Jürgen Ploppa, Pfullingen; Gerd Mak, Reutlingen, both of Fed. Rep. of Germany

[73] Assignee: H. Stoll GmbH & Co., Fed. Rep. of Germany

[21] Appl. No.: 119,869

[22] Filed: Nov. 13, 1987

[51] Int. Cl.[4] ..... D04B 35/10

[52] U.S. Cl. ..... 66/157; 66/163

[58] Field of Search ..... 66/157, 165, 163

[56] References Cited

U.S. PATENT DOCUMENTS

| | | | |
|---|---|---|---|
| 3,719,061 | 3/1973 | Hadam et al. | 66/157 |
| 3,780,542 | 12/1973 | Schieber | 66/157 X |
| 3,838,584 | 10/1974 | Graser | 66/157 X |
| 3,995,450 | 12/1976 | Rozett | 66/157 X |
| 4,744,227 | 5/1988 | Whitener et al. | 66/163 |

FOREIGN PATENT DOCUMENTS

| | | | |
|---|---|---|---|
| 2109552 | 6/1983 | United Kingdom | 66/157 |
| 2132233 | 7/1984 | United Kingdom | 66/157 |

*Primary Examiner*—Ronald Feldbaum

*Attorney, Agent, or Firm*—Jones, Tullar & Cooper

[57] ABSTRACT

In a safety device, in particular for flat-bed knitting machines, with which, by means of a shutoff device, stoppage of the carriages associated with a drive apparatus of the machines in the event of a change in the power of the carriages as compared with applicable normal operation resulting from disruptions in removal of the goods, loop formation and yarn insertion, excessively high loop tightness specification or the like, is effected. A measuring device is provided for detecting a torque-proportional variable of the drive mechanism. Actual values of the torque-proportional variable are deliverable to a central processing unit and an adjustable comparator device, and the comparator device is provided by the central processing unit, with threshold values for this torque-proportional variable, serving as processed actual value for the torque-proportional variable. Finally, by means of the comparator device, the shutoff device is triggerable as soon as the applicable threshold value is exceeded. Thus in a safety device of this kind, the varying conditions in individual flat-bed knitting machines of the same of different types and in the various operating programs can be taken into account, because the safety device can be made adequately sensitive for each case.

28 Claims, 2 Drawing Sheets

SAFETY DEVICE FOR FLAT-BED KNITTING MACHINES

BACKGROUND OF THE INVENTION

The present invention relates to a safety device, in particular for flat-bed knitting machines, having driven cam carriages, which detects the power delivered to the carriages.

For interruptions and malfunctions in the operation of such machines having a drive mechanism, a mechanical safety device having a lever or slides has heretofore been used, which is biased by one or two springs which by their initial tension determine the allowable resistance load limit at which, when it is exceeded, the sled drive mechanism is shut down. Prior art of this kind is described, for example, in the introduction to examined German Patent Application DE-AS No. 21 20 824.

This known safety device not only has the disadvantage that it is relatively sluggish and does not come into action until after a certain amount of delay, because for the safety device to be tripped, this safety device must first travel a certain displacement distance counter to the force of the spring or springs; it also has the disadvantage that a safety device of this kind is capable of being adjusted to only a single very specific threshold value. The power necessary for the cam carriage or carriages over the needle beds is not a constant. Instead, it depends on the number of needles in operation, the number of cams used, the type of operation, the tightness in the loops, and the like. Furthermore, even among individual machines of the same type, it also varies for reasons having to do with manufacturing tolerances. In the known safety device, the threshold value must therefore be set, by trial and error, at least to the maximum expected value for the power of the carriages of the machine type involved. In addition, when flat-bed knitting machines are restarted after being idle for a relatively long period, for example overnight, one problem is that more power is required than after the machine has warmed up. As a rule, this is taken into account by the operators of the machine by adjusting the safety device by hand, et they may fail to reset it after the machine has warmed up.

The invention also relates to a safety device, in particular for flat-bed knitting machines having needle beds, driven cam carriages and piezoelectric oscillation pickups secured to the needle beds which detects impact-like mechanical loads of the needle bed.

In a safety device of this kind, known from examined German Patent Application DE-AS No. 21 20 824, piezoelectric oscillation pickups are used, one of Which is attached to each needle bed. The evaluation of the output signals of these two piezoelectric oscillation pickups per flat-bed knitting machine is effected in parallel fashion with the aid of a voltage divider circuit and a single trigger circuit, connected therewith, for the shutoff device. Once again, the safety device is disadvantageous because each piezoelectric oscillation pickup is set to a quite specific fixed threshold value. The mechanical loads on the needle beds, however, depend on the speed of the carriage assembly, the number of cams, and on the manufacturing tolerances of the machine. Thus once again it is necessary here for the threshold value of the known safety device to be set, by trial and error, above the value that would be expected in the worst case during non-malfunctioning operation. As a result, it is impossible to take into account the fact that the situation can vary from one machine to another and that conditions when a machine starts up after a relatively long idle period differ very greatly from operation in the warmed-up state of the machine.

Furthermore, the present invention relates to a safety device for flat-bed knitting machines with which both the changes that occur in the power of the carriages and the changes that occur in the mechanical load of the needle beds are detected and can lead to a shutoff of the flat-bed knitting machine. None of the aforementioned different malfunction and interruption conditions can be optimally detected by only a part of the safety device in the prior art. For example, European patent 79 386 discloses a safety device which is based on monitoring the change in the carriage speed. In modern drive mechanisms, however, the carriage speed does not change in the event of the aforementioned first disruptions if the carriage is moving sluggishly, and no reduction in speed is to be expected in the second possible disruption mentioned above, in the event of shocks resulting from needle breakage, because the masses of the carriage assembly that are moved are so great that needle or jack butts can be sheared off without affecting the carriage speed.

SUMMARY OF THE INVENTION

It is therefore an object of the present invention to provide a safety device for knitting machines, and in particular flat-bed knitting machines having needle beds and driven cam carriages, with which the varying conditions in individual flat-bed knitting machines of the same or different types and in the various operating programs can be taken into account in such a way that the safety device can be made adequately sensitive both to a change in the power of the carriage assembly and to a change in the mechanical load of the needle beds.

In a safety device of the types discussed above, this object is attained by the means of a measuring apparatus for detecting a proportional variable in the operation of the machine. The actual values of the proportional variable are delivered to a central processing unit (CPU) and an adjustable comparator circuit(s). The CPU provides the comparator circuit(s) with threshold values of the variable and a shutoff signal generated when the actual value exceeds the threshold value.

The safety device according to the invention, which responds to a change in the power of the carriage assembly, advantageously uses a torque-proportional variable, which is thus also proportional to the power of the carriage assembly. Since the thresholds are specified by the central processing unit (CPU), they can in each case be brought very close to the actual values that occur, so that substantially equally high sensitivity of the safety device is attained for every flat-bed knitting machine.

In a hydraulic drive, for instance, the torque-proportional variable can be the fluid pressure. In a preferred exemplary embodiment of the present invention, an electric drive adjusted or regulated to a constant rpm can be used, so that the motor current is used as the torque-proportional variable. According to the present invention, a three-phase synchronous motor is preferably used, the motor current of which is detected in at least two phases by the measuring device, and the sum of the two values is delivered to the comparator circuit.

The safety device according to the invention that responds to a change in the mechanical load of the needle beds is made considerably more sensitive by providing that each needle bed has a separate piezoelectric oscillation pickup on its two long ends, and by the provision of a special evaluation circuit, so that the oscillations that in any case arise in different machines can be detected in a differentiated manner and the specified threshold values can be adapted to them.

A further increase in the sensitivity is possible if, as in a preferred exemplary embodiment of this safety device according to the invention, the two piezoelectric oscillation pickups of each needle bed are connected to the comparator device via a sum forming circuit. This makes it possible to obtain substantially the same measured values, at least at both ends of the needle bed, regardless of the location on the needle bed from which the impact wave originates. The situation is correspondingly the same for the central region of each needle bed, because here again the variables of the two oscillation pickups are added together.

In the two types of safety devices according to the invention discussed, the torque-proportional or load-proportional variable will be measured continuously, and storable discontinuously, in the form of the highest value occurring during a predetermined period, in a hold circuit, which is intended for sampling of the stored values by the central processing unit and is connected with this central processing unit; the sampled stored values form the basis for a change in the specified threshold values. In this manner, an envelope curve corresponding to the actual load profile can be plotted. It is also possible, based on trial and error or on measurements taken in non-malfunctioning operation, to specify threshold values that take into account the maximum loads that occur and that therefore contribute to high sensitivity on the part of the safety device.

Depending on the changes in the power of the carriage assembly or in the mechanical load of the needle beds occurring over one carriage stroke, it is suitable either, over the course of one carriage stroke at a time, to store in memory the highest value of the torque-proportional variable and use it for changing the threshold value for the ensuing stroke, or to divide the carriage stroke into operating zones (I–III) that require approximately the same power of the carriages, within which the highest value of the torque-proportional variable at a time is stored; these values are used for changing the applicable threshold values in the corresponding operating zones of subsequent carriage strokes. If the changes resulting over the carriage stroke are slight, then it is possible in a simple manner to proceed by the first alternative, while if greater changes occur over the carriage stroke, it is suitable in terms of the sensitivity of the safety device to proceed by the second alternative.

It is advantageously also to determine the corresponding operating zones as a function of the knitting program that has been input, that is, as a function of machine speed, the number of cams, the number and types of needles operating, and the like.

A safety device in which the detection of both the power of the carriage assembly and of the mechanical load of the needle beds is combined has the advantage that all the malfunctions and interruptions mentioned can be detected with high sensitivity and reliability and also can be distinguished from one another.

Further details of the invention will become apparent from the ensuing detailed description of a preferred embodiment of the invention, referring to the drawings.

DESCRIPTION OF THE PREFERRED EMBODIMENT

Figure 1:
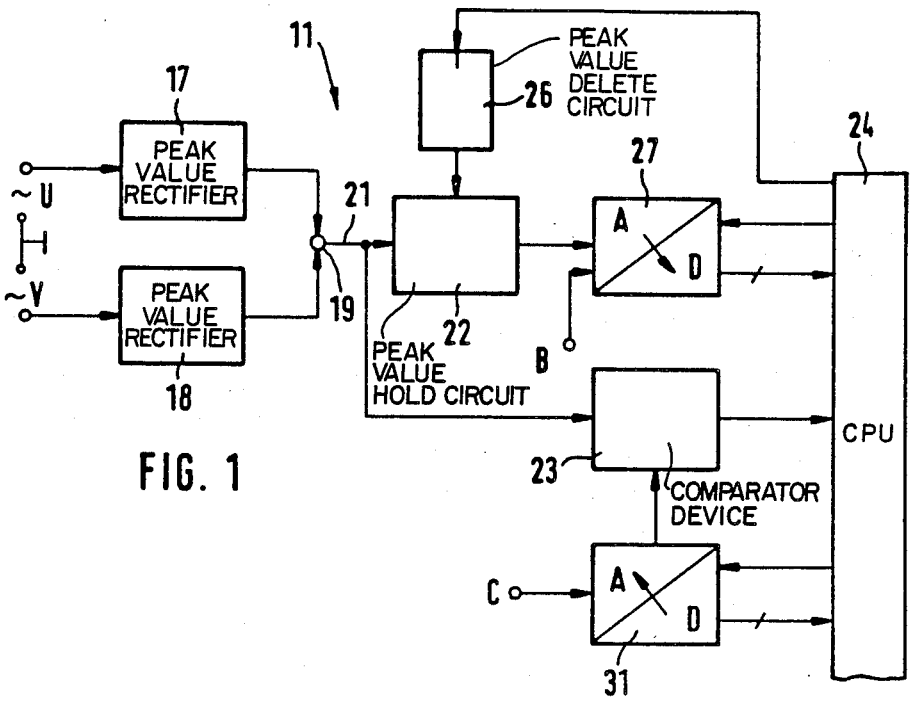
FIG. 1 illustrates part of a block circuit diagram having the drive current monitoring device of a safety device in accordance with a preferred exemplary embodiment of the present invention.

The safety device in accordance with a preferred exemplary embodiment of the present invention shown the drawing is of a kind that is suitable in particular not only for flat-bed knitting machines but also for circular knitting machines. It comprises two safety device parts first, a drive current monitoring device 11, with which the stoppage of the cam carriages, not shown, that have been driven over the needle beds 12, is effected in the event a change, as compared with the applicable normal operation, occurs in the power of the cam carriages as a consequence of interruptions or malfunctions in terms of the removal of the knitted articles, the operations of loop formation and yarn insertion, if an excessive loop tightness is specified, or the like; and second, an impact monitoring device 13, with which the stoppage of the cam carriages is effected, by means of piezoelectric oscillation pickups 14, 15 (so-called piezo elements) secured to the needle beds 12, by comparison with changes, as compared with the applicable normal operation, in the mechanical load of the needle beds 12 as a consequence of shocks or the like, for example. Sluggishness of the cam carriages as compared with normal operation, which is associated with an increased torque output of a drive mechanism of the cam carriages and hence with an increased current consumption when an electrical drive mechanism is use, is monitored by the drive current monitoring device 11; on the other hand, abrupt or sudden stresses on the front and/or rear needle bed 12V and 12H, caused for example by shearing off of needle or jack butts, are monitored with the aid of the impact monitoring device 13. In all cases, a shutoff of the machine is attained. However, it will be understood that in the safety device according to the invention, instead of the combination of the two, it is also possible to provide only one of the two monitoring devices 11 or 13 in the manner according to the invention. Instead of detecting the motor consumption current, of an electrical drive mechanism, the drive current monitoring device 11 can detect some, other torque-proportional variable (for instance hydraulic flow quantity and/or flow pressure;, i some other kind of drive, for instance a hydraulic motor, is used.

In a manner not shown, an electrical drive mechanism in the form of a constant-rpm three-phase synchronous motor is used for moving the carriage assembly back and forth in the flat-bed knitting machine that is to be monitored; in two of the three phases (for example, U and V) of this motor, a measuring device for measuring the consumption current and thus a variable proportional to the torque produced is provided. One peak value rectifier 17 and 18, respectively, is provided in each measuring current circuit of the two measuring phases, the outputs of these rectifiers being carried to an adding circuit 19, at the output 21 of which the sum of the outputs of the two peak value rectifiers 17, 18 always appears. The output 21 of the circuit 19 is carried to both a first input of a peak value hold circuit 22 and to a first input of a pre-settable or adjustable comparator or comparator device 23. The output of the comparator device 23 is connected to a central processing unit (CPU) or computer 24.

Figure 4:
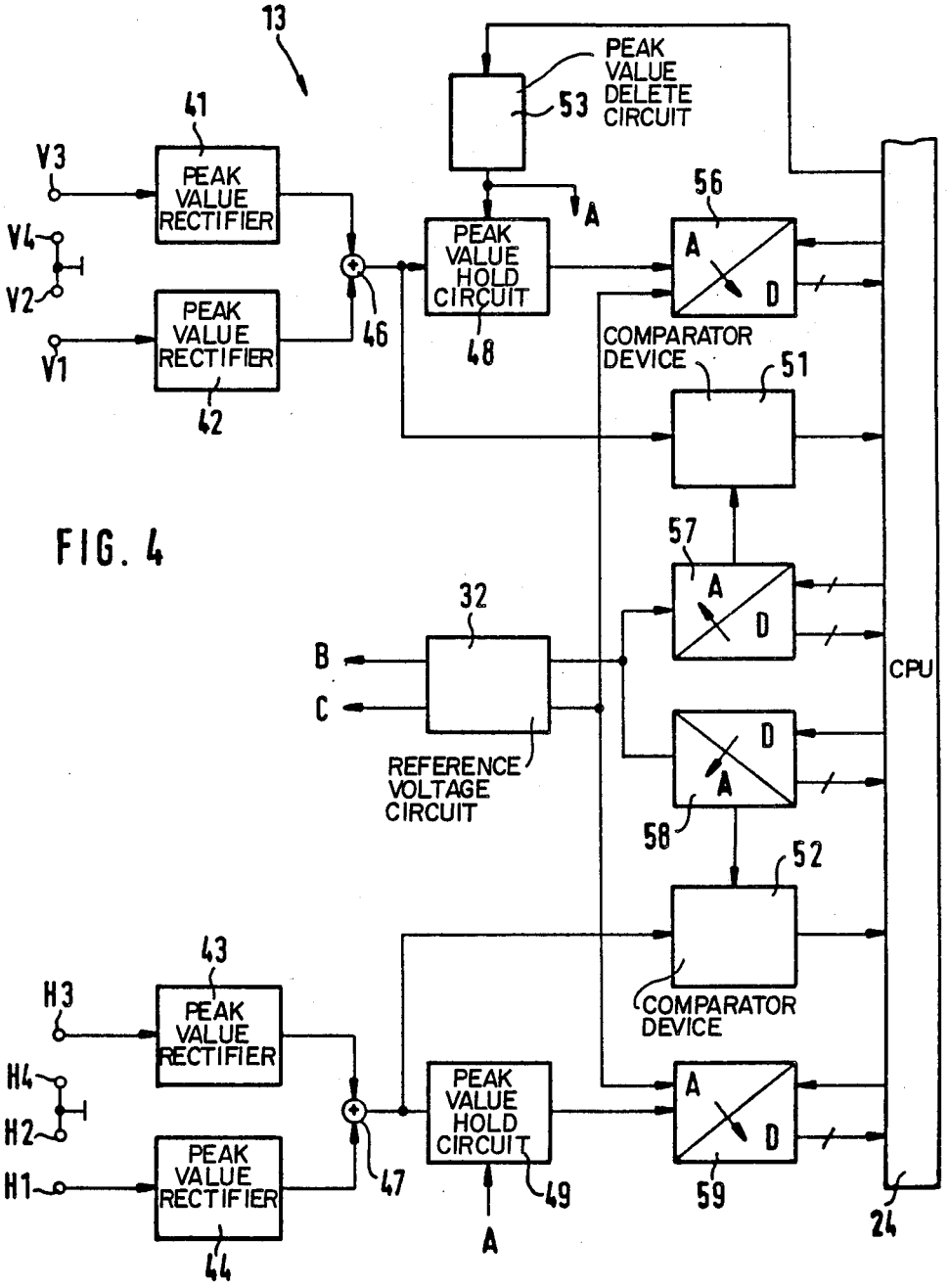
FIG. 4 illustrates part a block circuit diagram having the impact monitoring device of the safety device according to the present invention.

A second input of the peak value hold circuit 22 is connected to a peak vale delete circuit 26, which is supplied with an input signal from the CPU 24. The output of the peak value hold circuit 22 is carried to a first input of a analog/digital (A/D) converter 27, the first output of which, serves to sample the peak values, and the second output of which is connected to the CPU 24. Connected to a second input of the comparator device 23 is a digital/analog (D/A) converter 31, the first input of which serves to set the comparator threshold, and the second input of which is connected to the CPU 24. The connections B and C of the A/D converter 27 and D/A converter 31, respectively, are connected to the corresponding outputs of a reference voltage circuit 32 (see FIG. 4).

It will be understood that a direct current drive mechanism regulated to constant rpm can also be used as the electrical drive, in which case the armature current is measured, and this measuring circuit is connected to the peak value hold circuit 22. In each case, the drive mechanism used is preferably reversible (to reverse the direction of rotation), so that arbitrary carriage stroke lengths can be specified.

The drive current monitoring device 11 functions as follows:

The settable comparator device 23 is set, at the beginning of operation of the machine or when there is a new knitting program, to a current threshold value that is located somewhat above the maximum consumption current to be expected in the phase or phases during one carriage stroke (without taking the carriage reversal into account). During operation, for instance during the first carriage stroke, the consumption currents measured in phases U and V are delivered to the peak value rectifiers 17 and 18, from which the sum is carried to the peak value hold circuit 22. This hold circuit 22, which has previously been set to 0, detects and holds the highest current value picked up from the drive mechanism over the applicable carriage stroke. At the end of the carriage stroke, this peak current value is sampled via the A/D converter 27 by the CPU 24 in accordance with a program, processed (with a margin of safety added), and delivered via the D/A converter 31 as a possibly new threshold current value to the preset comparator device 23. For instance, if an excessively high peak current value is taken into account in the specified pre-setting of the settable comparator device 23, then if the peak current value measured over the length of the carriage stroke is now lower, a lower current threshold value is specified for the next carriage stroke. The same procedure is followed in the second and subsequent carriage strokes as well. As a result, the measurements or "trial and error learning" via the CPU 24 over the preceding carriage stroke can be r-used as a new specification for the comparator device 23. This is of particular significance, for example, when a new knitting program is introduced, or at the beginning of a new knitting cycle by the flat-bed knitting machine at the beginning of a new day, because in the first case the torque output values and hence the current consumption values that arise can vary, since these depend for instance on the number of needles in operation, on the loop tightness, on the number of cams in operation, or for instance on whether or how many of the needles are in the knitting or clearing, yarn insertion, tuck or knockover position and the like, while in the second case the fact is taken into account that in cold operation the power of the carriage assembly is greater than in warmed-up normal operation.

Now if during one of these carriage strokes a change in the power of the carriage assembly occurs and thus in the torque produced or current consumed, to an extent that the specified current threshold value is exceeded, then the comparator device 23, which continuously performs a comparison between the set-point value (threshold value) and the actual value delivered by the circuit 19, emits a shutoff signal at its output, which, via the CPU 24, is carried to a shutoff device, not shown, by means of which the drive of the carriage assembly is shut off, thus stopping the flat-bed knitting machine, and a more-detailed fault report is emitted. This kind of change in the drive current consumption or torque production can take place, for instance, if the knitted goods are no longer correctly removed, if the needles get into several loops in a knitted article that is no longer correctly positioned in the needle area, or if a tightness figure that is actually too high has been specified for the needles, that is, if an overly tight mesh causes the needle heads to break.

Figure 2:
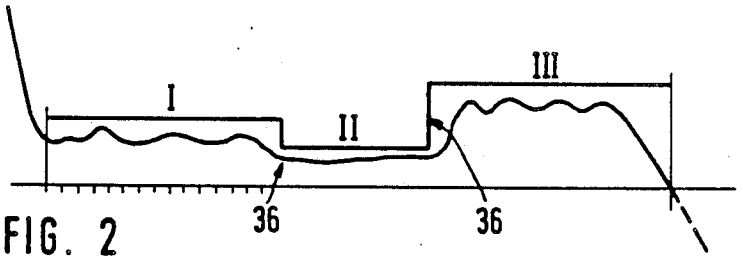
FIG. 2 is a schematic view of the current consumption or torque produced by the drive mechanism during one carriage stroke, and an envelope curve derived from it.

It has been noted above that the peak current consumption value that arises along one complete carriage stroke (without a reversal) is stored in the hold circuit, and at the end of each carriage stroke a delete pulse is emitted to the hold circuit. However, it is also possible to divide the carriage stroke into one, two or more zones, in which approximately identical conditions prevail for each, in terms of the power of the carriage assembly and hence the torque produced or current consumed by the electric drive mechanism. In FIG. 2, for example, three zones along one carriage stroke (or reversal zones) are plotted, in each of which approximately identical conditions prevail, and the curve 36 which represents the actual course, can for instance be approached by an envelope curve 37 for threshold values to be selected on a zone-by-zone basis. For example, in zone I, yarn insertion is substantially performed, while in zone II many of the needles are set for knockover, while in zone III virtually all the needles are clearing. If a peak consumption current value is now to be stored in the hold circuit 22, with the aid of the drive current monitoring device 11, during each of the zones I–III along one carriage stroke, then it is necessary for the CPU 24 to sample the peak value at the end of each zone I, II, III, process it and store it as a new threshold value, which is specified, however, to the comparator device 23 only for the applicable zone I, II, III of the following stroke. At the same time, after each measurement the CPU 24 emits a delete pulse via the peak value delete circuit 26 to the hold circuit 22, so that in the following zone I–III the hold circuit can detect and store a new peak consumption current value. In this way, the aforementioned envelope curve 37, which is derived from the curve 36 with the addition of a margin of safety, can be generated within the CPU 24. The CPU 24 specifies the profile of the threshold values in accordance with this envelope curve 37. It is also possible for the CPU 24 to vary the pick-up envelope curve or profile, taking into account the knitting program that has been input, or in other words taking into account the fact of how many of the needles are operating, that is, are in the knitting or clearing, yarn insertion, tucking, or knockover position, how many of the cams are in use, what loop tightness has been specified, and so forth. If this changes, in the manner to be taken into account, during the knitting of one knitted article, so that at the beginning of such a change a new threshold value is specified, it is then varied by the measured trial and error procedure described above. It will be understood that depending upon the type of knitted article and thus upon the knitting program, a division into more or fewer zones in which an approximately identical or comparable torque production takes place can be made.

The CPU 24 also assures that during carriage reversal the threshold current consumption value is increased in such a manner that the high positive or negative (braking) torque production taking place during the carriage stroke reversal is within this threshold value. This is particularly necessary where directionally reversible drive mechanisms are used for attaining variable strokes.

Figure 3:
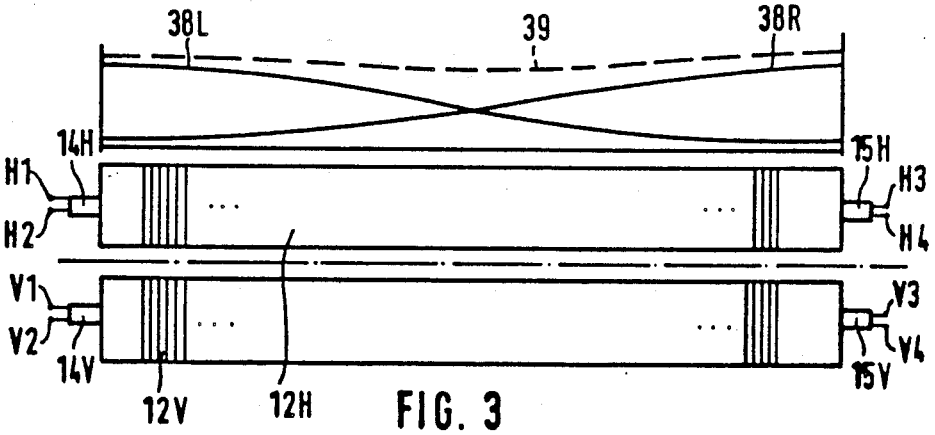
FIG. 3 is a schematic representation of the mechanical portion of an impact monitoring device of the safety device in accordance with the preferred exemplary embodiment of the present invention.

FIG. 3 schematically shows the front needle bed 12V and the rear needle bed 12H of a flat-bed knitting machine on the two long ends of each of which one piezoelectric oscillation pickup 14V, 14H or 15V, 15H is secured. Piezoelectric oscillation pickups and their attachment to one end of the needle bed are known per se, for example from the examined German Patent Application DE-AS No. 21 20 824 mentioned above. An essential feature in the impact monitoring device 13 according to the invention for the safety device is that each needle bed 12V, 12H has piezoelectric oscillation pickups 14 and 15 at two locations, remote from one another, of the propagation of the shock wave. As a result, there is increased sensitivity in detecting the shock waves that occur as a result of abrupt changes in the mechanical load of the needle beds, as is shown in graphic form above the needle beds 12, because the shock waves are detected over the needle bed length by both pickups 14 and 15, and their values (curves 38L, R) are added together (curve 39), so that an approximately identically high sensitivity exists over the length of the needle bed.

The electrical outputs V1–V4 or H1–H4 of the piezoelectric oscillation pickups 14V, 14H, 15V, 15H respectively secured to the left and right ends of the front needle bed 12V and the rear needle bed 13H are each delivered to a two-way peak rectifier 41, 42, 43 and 44, respectively. The rectified electrical output signals of the various oscillation pickups associated with one another, 14V and 15V or 14H and 15H, of one of the needle beds 12V or 12H are carried to an adding circuit 46 or 47. The further processing of these peak current values, emitted by a respective pair of piezoelectric oscillation pickups 14, 15 and added together, corresponds to the processing shown in FIG. 1 for the peak current consumption values of the electric drive mechanism.

The output of the adding circuit 46, 47 is thus delivered both to a peak value hold circuit 4 or 49 and to a presettable comparator device 51 or 52, respectively. The two peak value hold circuits 48, 49 are connected to a common peak value delete circuit 53, the input of which is connected to the CPU 24 that is common to both monitoring devices 11 and 13. The peak value hold circuits 48, 49 are connected to first A/D converters 56 and 59, respectively. D/A converters 57, 68 are connected to the presettable comparator device 51 and 52, respectively. The outputs and the inputs for sampling the peak value or for setting a threshold value of the A/D converters 56, 59 or of the D/A converters 57, 58 and the shutoff output of the presettable comparator devices 51, 52 are connected to the CPU 24. The two A/D converters 56, 59 and the two D/A converters 57, 58 are each connected in parallel with one input of the reference voltage circuit 32.

By means of the impact monitoring device 13, a shutoff of the carriage drive and thus a stoppage of the flat-bed knitting machine is possible with differentiation of factors taken into account; that is, it is possible to consider whether a sudden change in the mechanical load due to a shock-like or sudden strain is taking place in the front needle bed 12V or in the rear needle bed 12H. The function of this impact monitoring device 13 is directly comparable for both the front and rear needle bed with the function of the drive current monitoring device 11. At the beginning of a knitting program or of a work day, once again a threshold value for the mechanical load on the front and rear needle bed that is allowable during normal operation is specified, and these two threshold values are corrected by the CPU 24 via the sampling of the highest actual values measured. Once again, it is possible either to store one peak value per carriage stroke, or one peak value for each of a plurality of zones (for instance I–III) along the carriage stroke, and sample it by means of the CPU 24, resulting in an envelope curve or profile of threshold values, the basis of which is the measured values. Once again, the threshold values can be preset in accordance with a knitting program or a change to be taken into account in the operation of the machine in the course of knitting an article. Furthermore, once again the threshold values are increased accordingly by the CPU 24 during the stroke reversal, so that the mechanical oscillations of the needle beds that occur during the stroke reversal will be within the threshold values. If a sudden change occurs in the mechanical strain on the front or rear needle bed, for instance because the needle and/or jack butt strikes a shunt head or similar protruding cam portion, without being moved into a track causing that butt to be sheared off, then the resultant peak value, which exceeds the threshold value, causes the applicable comparator device 51 or 52 to emit a shutoff signal to the CPU 24. In this process, an indication is provided as to which of the two needle beds this impermissible change in the mechanical load has occurred, and to what extent.

What is claimed is:

1. A safety device, in particular for flat-bed knitting machines having at least one cam carriage and drive means for stoppage of the machine in the event of a change in the power to the carriages as compared with applicable normal operation resulting from disruptions in removal of the goods, in loop formation and yarn insertion, or caused by the specification of excessively high loop tightness or the like, comprising:

a measuring means for detecting the actual value of a torque-proportional variable associated with the drive means;

a central processing unit for receiving the actual values of the torque-proportional variable and for generating threshold values of the torque-proportional variable;

an adjustable comparator device for receiving the actual values of the torque-proportional variable and the threshold values, said actual values and said threshold values being compared and a shutoff signal generated by the adjustable comparator device when an actual value exceeds a threshold value; and a shutoff device triggered by the shutoff signal for stopping the machine.

2. The safety device as defined in claim I, wherein the drive means comprises an electrical drive and the torque-proportional variable comprises the current associated with the electrical drive.

3. The safety drive as defined in claim 2, further comprising:

a summing circuit, wherein the electrical drive comprises a three-phase synchronous motor, the measuring means detects the motor current in at least two phases which are added by the summing circuit, and delivered to the central processing unit and the adjustable comparator circuit.

4. The safety device as defined in claim 1, further comprising:

a hold circuit connected to the central processing unit, wherein the torque-proportional variable is measured continuously and stored discontinuously in the form of the highest value occurring during a predetermined period in the hold circuit, and the central processing unit samples the stored measurement, said sampling forming the basis for change in the threshold values.

5. The safety device as defined in claim 4, further wherein the predetermined period corresponds to the course of one cam carriage stroke, and the threshold values are changed for the ensuing stroke.

6. The safety device as defined in claim 4, further wherein the predetermined period corresponds to the course of one cam carriage stroke which is divided into three (I–III) operating zones that require approximately the same carriage power, within which zones the highest value of the torque-proportional variable is stored, said value being used to change the applicable threshold values in the corresponding operating zones of subsequent carriage strokes.

7. The safety device as defined in claim 6, further wherein the adjustable corresponding operating zones are determined as a function of the input knitting program.

8. The safety device as defined in claim 4, further wherein the comparator circuit is adjustable by hand for a predetermined initial threshold value at the beginning of an operating cycle of the machine and/or of a new knitting program.

9. The safety drive as defined in claim 4, further wherein the hold circuit is provided with a delete input.

10. The safety device as defined in claim 9, further wherein the predetermined period corresponds to the course of one cam carriage stroke, and the threshold values are changed for the ensuing stroke.

11. The safety device as defined in claim 9, further wherein the predetermined period corresponds to the course of the cam carriage stroke which is divided into three (1-111]operating zones that require approximately the same carriage power, within which zones the highest value of the torque-proportional variable is stored, said value being used to change the applicable threshold values in the corresponding operating zones of subsequent carriage strokes.

12. The safety device as defined in claim 11, further Wherein the corresponding operating zones are determined as a function of the input knitting program.

13. The safety device as defined in claim 9, further wherein the comparator circuit is adjustable by hand for a predetermined initial threshold value at the beginning of an operating cycle of the machine and/or of a new knitting program.

14. A safety device for flat-bed knitting machines having at least one needle bed, piezoelectric oscillation pickups secured to each needle bed, at least one cam carriage and drive means, for stoppage of the machine in the event of a change occurring in the mechanical load of the needle beds as determined by the pickups as a consequence of impacts or the like as compared with the applicable normal operation, comprising:

a central processing unit;

an adjustable comparator device associated with each needle bed; and a shutoff device, wherein:

each needle bed is provided on both of its long ends with a piezoelectric oscillation pickup;

each piezoelectric oscillation pickup of a needle bed is associated with the adjustable comparator device f that needle bed, and with the outputs from each piezoelectric oscillation pickup being connected to its associated adjustable comparator device;

the central processing unit receives actual values of the mechanical load on each needle bed as a load-proportional variable, and each adjustable comparator device receives the actual values associated with its needle bed; and the central processing unit generates threshold values received by the appropriate adjustable comparator device where a comparison is made with the actual values received and a shutoff signal generated which triggers the shutoff device for stopping the machine.

15. The safety device as defined in claim 14, further comprising:

a hold circuit connected to the central processing unit, and further wherein:

the load-proportional variable is measured continuously and stored discontinuously in the form of the highest value occurring during a predetermined period in the hold circuit; and the central processing unit samples the stored measurement, said sampling forming the basis for a change in the threshold values.

16. The safety device as defined in claim 15, further wherein:

the hold circuit is provided With a delete input.

17. The safety device as claimed in claim 15, further wherein:

the predetermined period corresponds to the course of one cam carriage stroke; and the threshold values are changed for the ensuing stroke.

18. The safety device as defined in claim 15, further wherein:

the predetermined period corresponds to the course cam carriage stroke which is divided into three (I–III) operating zones that require approximately the same carriage power, within which zones the highest value of the load-proportional variable is stored, said value being used to change the applicable threshold values in the corresponding operating zones of subsequent carriage strokes.

19. The safety device as defined in claim 18, further wherein:

the corresponding operating zones are determined as a function of the input knitting program.

20. The safety device as defined in claim 14, further comprising:

an adding circuit associated with each needle bed and connected to the adjustable comparator circuit of that needle bed, and further wherein:

both piezoelectric oscillation pickups of each needle bed are connected to the adding circuit associated with its needle bed.

21. The safety device as defined in claim 20, further comprising:

a hold circuit connected to the central processing unit, and further wherein:

the load-proportional variable is measured continuously and stored discontinuously in the form of the highest value occurring during a predetermined period in the hold circuit; and the central processing unit samples the stored measurement, said sampling forming the basis for a change in the threshold values.

22. The safety device as defined in claim 21, further wherein:

the hold circuit is provided With a delete input.

23. The safety device as defined in claim 20, further wherein:

the predetermined period corresponds to the course of one cam carriage stroke; and the threshold values are changed for the ensuing stroke.

24. The safety device as defined in claim 20, further herein:

the predetermined period corresponds to the course cam carriage stroke which is divided into three (I–III) operating zones that require approximately the same carriage power, within which zones the highest value of the load-proportional variable is stored, said value being used to change the applicable threshold values in the corresponding operating zones of subsequent carriage strokes.

25. The safety device as defined in claim 20, further wherein:

the corresponding operating zones are determined as a function of the input knitting program.

26. The safety device as defined in claim 14, further wherein:

the threshold value delivered to the adjustable comparator circuits is adjustable to a correspondingly very high value during reversal of the carriage stroke.

27. The safety device as defined in claim 14, further wherein:

the adjustable comparator circuits are adjustable by hand for a predetermined initial threshold value at the beginning of an operating cycle of the machine and/or of a new knitting program.

28. A safety device, in particular for flat-bed knitting machines having at least one needle bed, piezoelectric oscillation pickups secured to each needle bed, at least one cam carriage and drive means for stoppage of the machine in the event of a change occurring in the mechanical load of the needle beds as determined by the pickups as a consequence of impacts or the like as compared with the applicable normal operation and/or in the power to the carriages as compared with applicable normal operation resulting from disruptions in removal of the goods, in loop formation and yarn insertion, or caused by the specification of excessively high loop tightness or the like, comprising:

a measuring means for detecting the actual value of a torque-proportional variable associated with the drive means;

an adjustable comparator device associated with each needle bed, each needle bed being provided on both of its long ends with a piezoelectric oscillation pickup, each piezoelectric oscillation pickup of needle bed being associated with an adjustable comparator device of that needle bed, and with the outputs from each piezoelectric oscillation pickup being connected to its associated adjustable comparator device;

a central processing unit for receiving the actual values of the torque-proportional variable and for generating threshold values of the torque-proportional variable, and for receiving actual values of the mechanical load on each needle bed as a load-proportional variable, each adjustable comparator device receiving the actual values associated with its needle bed, and generating threshold values received by the appropriate adjustable comparator device where a comparison is made with the actual values received and a shutoff signal generated;

a further adjustable comparator device for receiving the actual values of the torque-proportional variable and the threshold values, said actual values and said threshold values being compared and a shutoff signal generated; and a shutoff device triggered by either shutoff signal for stopping the machine.

* * * * *

UNITED STATES PATENT AND TRADEMARK OFFICE

CERTIFICATE OF CORRECTION

PATENT NO. : 4,790,153

DATED : December 13, 1988

INVENTOR(S) : Jurgen Ploppa

It is certified that error appears in the above-identified patent and that said Letters Patent is hereby corrected as shown below:

Claim 1, column 8, line 66, cancel "a" (first occurrence)

Claim 2, column 9, line 14, change "I" to --1--

Claim 3, column 9, line 25, change "circuit" to --device--.

Claim 8, column 9, line 54, between "the" and "comparator" insert --adjustable--, and change "circuit" to --device--.

Claim 12, column 10, line 6, change "Wherein" to --wherein--.

Claim 13, column 10, line 9, between "the" and "comparator" insert --adjustable--, and change "circuit" to --device--.

Claim 14, column 10, line 29, change "f" to --of--.

Claim 16, column 10, line 56, change "With" to --with--.

Claim 20, column 11, line 12, change "circuit" to --device--.

Claim 26, column 12, line 2, change "circuits" to --devices--.

Claim 27, column 12, line 7, change "circuits" to --devices--.

UNITED STATES PATENT AND TRADEMARK OFFICE

CERTIFICATE OF CORRECTION

PATENT NO. : 4,790,153

DATED : December 13, 1988

INVENTOR(S) : Jurgen Ploppa

It is certified that error appears in the above-identified patent and that said Letters Patent is hereby corrected as shown below:

Claim 28, column 12, line 24, cancel "a" (first occurrence).

Signed and Sealed this

Sixth Day of June, 1989

*Attest:*

DONALD J. QUIGG

*Attesting Officer*

*Commissioner of Patents and Trademarks*